US007475719B2

(12) United States Patent
Derosier et al.

(10) Patent No.: US 7,475,719 B2
(45) Date of Patent: Jan. 13, 2009

(54) HIGH-FREQUENCY, LOW-AMPLITUDE CORRUGATED FIN FOR A HEAT EXCHANGER COIL ASSEMBLY

(75) Inventors: Gregory Stephen Derosier, Eldersburg, MD (US); Richard Preston Merrill, Columbia, MD (US); George Robert Shriver, Sykesville, MD (US)

(73) Assignee: Evapco, Inc., Taneytown, MD (US)

( * ) Notice: Subject to any disclaimer, the term of this patent is extended or adjusted under 35 U.S.C. 154(b) by 0 days.

(21) Appl. No.: 11/638,474

(22) Filed: Dec. 14, 2006

(65) Prior Publication Data

US 2008/0142201 A1 Jun. 19, 2008

(51) Int. Cl.
*F28F 1/32* (2006.01)

(52) U.S. Cl. ..... 165/151; 165/182

(58) Field of Classification Search ..... 165/151, 165/182

See application file for complete search history.

(56) References Cited

U.S. PATENT DOCUMENTS 1,553,093 A * 9/1925 Modine ..... 165/151
1,557,467 A * 10/1925 Modine ..... 165/151
1,915,742 A * 6/1933 Mautsch ..... 165/151
1,920,313 A * 8/1933 Mautsch ..... 165/151
2,246,258 A * 6/1941 Lehman ..... 29/890.04
3,249,156 A * 5/1966 McGrew ..... 165/181
3,515,207 A * 6/1970 Lu ..... 165/151
3,645,330 A * 2/1972 Albright et al. ..... 165/151
4,586,563 A * 5/1986 Dubrovsky et al. ..... 165/151
5,174,370 A * 12/1992 Hallgren ..... 165/166
5,201,367 A * 4/1993 Dubrovsky et al. ..... 165/151
6,889,759 B2 * 5/2005 Derosier ..... 165/151

* cited by examiner

*Primary Examiner*—Allen J Flanigan
(74) *Attorney, Agent, or Firm*—Rader, Fishman & Grauer PLLC

(57) ABSTRACT

A high-frequency, low-amplitude corrugated fin for a heat exchanger assembly includes a plate member that extends horizontally and vertically to define a reference plane. The plate member has a plurality of conduit portions, a first and second series of corrugated segments formed in the plate member. The first and second series of corrugated segments undulate generally equidistantly relative to and from the reference plane as viewed in cross-section. The plurality of conduit portions is inter-dispersed throughout the plate member among the first and second series of corrugated segments. Each one of the first series of corrugated segments extends at a first angle relative to horizontal and each one of the second series of corrugated segments extend at a second angle relative to horizontal such that individual adjacent ones of the first and second series of corrugated segments form at least a generally chevron-shaped configuration as viewed in plan view.

1 Claim, 20 Drawing Sheets

HIGH-FREQUENCY, LOW-AMPLITUDE CORRUGATED FIN FOR A HEAT EXCHANGER COIL ASSEMBLY

FIELD OF THE INVENTION

The present invention relates to a fin for a heat exchanger coil assembly. More specifically, the present invention is directed to high-frequency, low-amplitude corrugated fin for a heat exchanger coil assembly.

BACKGROUND OF THE INVENTION

Heat exchanger coil assemblies are well known in the art. One such heat exchanger assembly is disclosed in U.S. Pat. No. 6,889,759 to Derosier and illustrated in FIGS. 1-9. In FIG. 1, a heat exchanger 10 includes a finned coil assembly 12, a housing 14 and a blower 16. Arrows 17 indicate a direction of air flow being drawn through the heat exchanger 10 by way of example only. The heat exchanger 10 includes an inlet manifold 18, an outlet manifold 20 and respective inlet and outlet pipes 19 and 21. Tubes 22 are joined by return bends 24. As is well-known in the art, an internal heat exchanger fluid is circulated from an inlet source through the inlet pipe 19 and the inlet manifold 18, then through the finned coil assembly 12, and then through the outlet manifold 20 and the outlet pipe 21 so that heat is exchanged between the internal heat exchange fluid in the coil assembly 12 and air that is drawn through the coil assembly 12 by the blower 16.

As shown in FIG. 1, a plurality of fins 26 constitutes the finned coil assembly 12. FIG. 2 discloses a single fin 26 fabricated from a plate material such as metal with acceptable heat exchange properties and is formed with a continuous series of corrugations 30 as best shown in FIG. 3. Note that the continuous series of corrugations 30 extend horizontally across the plate yet some of the corrugations as they extend horizontally across the plate are interrupted periodically by a plurality of conduit portions 32 arranged in a matrix of columns and rows as shown in FIGS. 2 and 3. With reference to FIG. 3, each conduit portion 32 has a flat piece 34 and collar 36. Each flat piece 34 is generally disposed in an imaginary reference plane RP as shown in FIGS. 3 and 4. Each flat piece 34 has a hole 38 that is formed through the fin 26. A respective collar 36 is connected to and projects from a corresponding one of the flat pieces 34 to define a transversely extending conduit 40 in communication with the hole 38.

With reference to FIG. 5, each corrugation 30 projects from the reference plane RP as viewed in cross-section at a height "h" and criss-crosses the reference plane RF as viewed in cross-section at a width w. A ratio h:w is in a range of approximately 0.32 and 0.7. Also, a number of corrugations 30 per inch as viewed in cross-section is in a range of approximately 8 and 24. Such fin 26 is considered a high-frequency, low-amplitude corrugated fin because this fin 26 includes many corrugations 30 connected in sequence in an exemplary form as a sine wave configuration within a relatively short distance as viewed in cross-section and the height "h" of the corrugations 30 is rather small. In other words, the high-frequency, low-amplitude corrugated fin 26 is a substantially continuous sequences of corrugations 30 occasionally interrupted by the conduit portions. Furthermore, a skilled artisan would comprehend that other cross-sectional configurations might be used such as a saw-toothed cross-sectional configuration, a trapezoidal cross-sectional configuration or other cross-sectional configurations known in the art.

The high-frequency, low-amplitude corrugated fin 26 as illustrated in the drawing figures performs as designed in many heat exchange applications. For instance, the high-frequency, low-amplitude corrugated fin 26 performs as designed when air flowing between facially-opposing fins 26 is to be heated. However, when the air flowing between facially-opposing fins 26 is to be cooled, particularly in a highly humid environment, there is a concern regarding moisture build-up on the high-frequency, low-amplitude corrugated fins 26. In a highly humid environment, if cooling of the air results in a temperature drop below the dew point, moisture can accumulate on the fins 26 resulting in a decrease of heat exchange efficiency. Furthermore, a sufficient amount of moisture can condense and accumulate within the valleys defined by the respective corrugations 30 forming water Wa in the valleys as shown by way of example in FIG. 6 effectively creating a liquid insulation layer between the flowing air and the fins themselves. It is theorized that since the fins 26 are high-frequency, low-amplitude corrugated fins, the curved walls forming the corrugations 30 retain the water in the valleys as a result of the capillary action. A significant amount of water can be retained in the valleys of the corrugations 30 by capillary action resulting in yet a further decrease of heat exchange efficiency of the finned coil assembly 12.

To overcome the problem of water being retained in the valleys of the high-frequency, low-amplitude corrugated fins 26, a modification can be made by orienting the corrugations 30 at an angle inclined relative to horizontal as shown in FIG. 7. Empirical test results indicate the optimum inclined angle might be in a range of 15° and 25° although other angles can be used. Note all of the corrugations 30 extend linearly at an inclined angle "a" relative to a horizontal line HL. As a result, water accumulating in the valleys as a result of capillary action can now drain by flowing downwardly along the inclined corrugations 30 and over the peaks of the corrugations 30 towards the edge of the fin 26 as illustrated by way of example in FIG. 7 by the multiple curving arrows CA.

In some applications, the high-frequency, low-amplitude corrugated fin 26 with its corrugations 30 extending at an inclined angle relative to horizontal is satisfactory. However, in other applications, using this high-frequency, low-amplitude corrugated fin 26 might be unsatisfactory. For example, in the processing plants such as meat processing plants which require refrigeration, government officials might shut down plant operations if water (most likely, in tiny droplet form) is carried outside of the housing 14. This situation might occur if the flowing air blows accumulated water off the outer vertical edges of the fins 26. To overcome this problem, two fins **26*a* and 26*b* with corrugations 30 oriented at inclined angles relative to horizontal could be used as the finned coil assembly 12 as shown in FIG. 8. Fin 26*a* and fin 26*b* are arranged juxtaposed to one another with the corrugations 30*a* of fin 26*a* oriented at an inclined angle relative to horizontal that directs water that might have accumulated in the valleys toward fin 26*b* and with the corrugations 30*b* of fin 26*b* oriented at an inclined angle relative to horizontal that directs water that might have accumulated in the valleys toward fin 26*a*. With this arrangement of angled corrugations, water flows toward and drains in the center of the heat exchanger 10** indicated by arrow W.

However, arranging two high-frequency, low-amplitude corrugated fins **26*a* and 26*b* in this manner has drawbacks. First, it is difficult to abut the two opposing ends of fins 26*a* and 26*b* at the center of the heat exchanger 10 in complete registration. As a result, a crack 42 is formed between the fins 26*a* and 26*b*. Such crack 42 increases the pressure drop of the air flowing from fin 26***a* to fin 26*b* resulting in reduced air flow, which, in turn, results in decreased heat exchange efficiency.

Furthermore, since complete registration of the two opposing ends of the fins 26*a* and 26*b* is difficult to achieve, the opposing corrugations 30*a* and 30*b* of the respective ones of the fins 26*a* and 26*b* might be positioned offset from one another as illustrated by way of example only in FIGS. 9A and 9B. Thus, fin 26*b* disposed offset from fin 26*a* effectively introduces structure into the air flow stream causing yet another pressure reduction, which, in turn, results in decreased heat exchange efficiency.

Also, although the juxtaposed fins 26*a* and 26*b* arranged as described above, might be a potential solution to draining away water accumulated in the valleys of the corrugations 30, in practice, fins with such angled corrugations are difficult to manufacture. It was noted during the manufacture of such fins with inclined-angled corrugations that the fin tended to move sideways through the forming tooling as it advanced therethrough resulting in the fin moving sideways off of the forming tooling.

It would be advantageous to provide a fin for a heat exchanger coil assembly that provides enhanced drainage for water that accumulates as a result of condensation. It would be preferable to provide a fin that permits water drainage between the opposing vertical edges of the fin and inhibits or minimizes water build-up on either one of the opposing vertical edges of the fin. It would also be advantageous to provide a fin for a heat exchanger coil assembly that drains water in a manner to inhibit water build-up in the valleys of the corrugations. The present invention provides these advantages.

OBJECTS AND SUMMARY OF THE INVENTION

It is an object of the invention to provide a high-frequency, low-amplitude corrugated fin for a heat exchanger coil assembly that provides enhanced drainage for water that accumulates as a result of condensation in a humid environment.

It is another object of the invention to provide a high-frequency, low-amplitude corrugated fin that preferably permits water drainage between the opposing vertical edges of the high-frequency, low-amplitude corrugated fin.

It is yet another object of the invention to provide a high-frequency, low-amplitude corrugated fin that preferably inhibits or minimizes water build-up on either one of the opposing vertical edges of the high-frequency, low-amplitude corrugated fin.

A still further object of the invention is to provide a high-frequency, low-amplitude corrugated fin for a heat exchanger coil assembly that appropriately drains water formed by an accumulation of condensation thereby inhibiting water build-up in the valleys of the corrugations.

Yet still a further object of the invention is to provide a high-frequency, low-amplitude corrugated fin with improved heat transfer capacity.

Accordingly, a high-frequency, low-amplitude corrugated fin for a heat exchanger assembly of the present invention is hereinafter described. The high-frequency, low-amplitude corrugated fin for the heat exchanger coil assembly includes a plate member extending horizontally in a horizontal direction and vertically in a vertical direction to define a reference plane. The plate member has a plurality of conduit portions, a first series of corrugated segments formed in the plate member and a second series of corrugated segments formed into the plate member. The first and second series of corrugated segments undulate generally equidistantly relative to and from the reference plane as viewed in cross-section. The plurality of conduit portions is inter-dispersed throughout the plate member among the first and second series of corrugated segments. Each conduit portion has a flat piece and a collar. Each flat piece is generally disposed in the reference plane and has a hole formed transversely therethrough. A respective collar is connected to and projects from a corresponding one of the flat pieces to define a transversely extending conduit in communication with the hole. Each one of the first series of corrugated segments extends at a first angle relative to the horizontal direction and each one of the second series of corrugated segments extend at a second angle relative to the horizontal direction such that individual adjacent ones of the first and second series of corrugated segments form a substantially chevron-shaped configuration as viewed in plan view.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
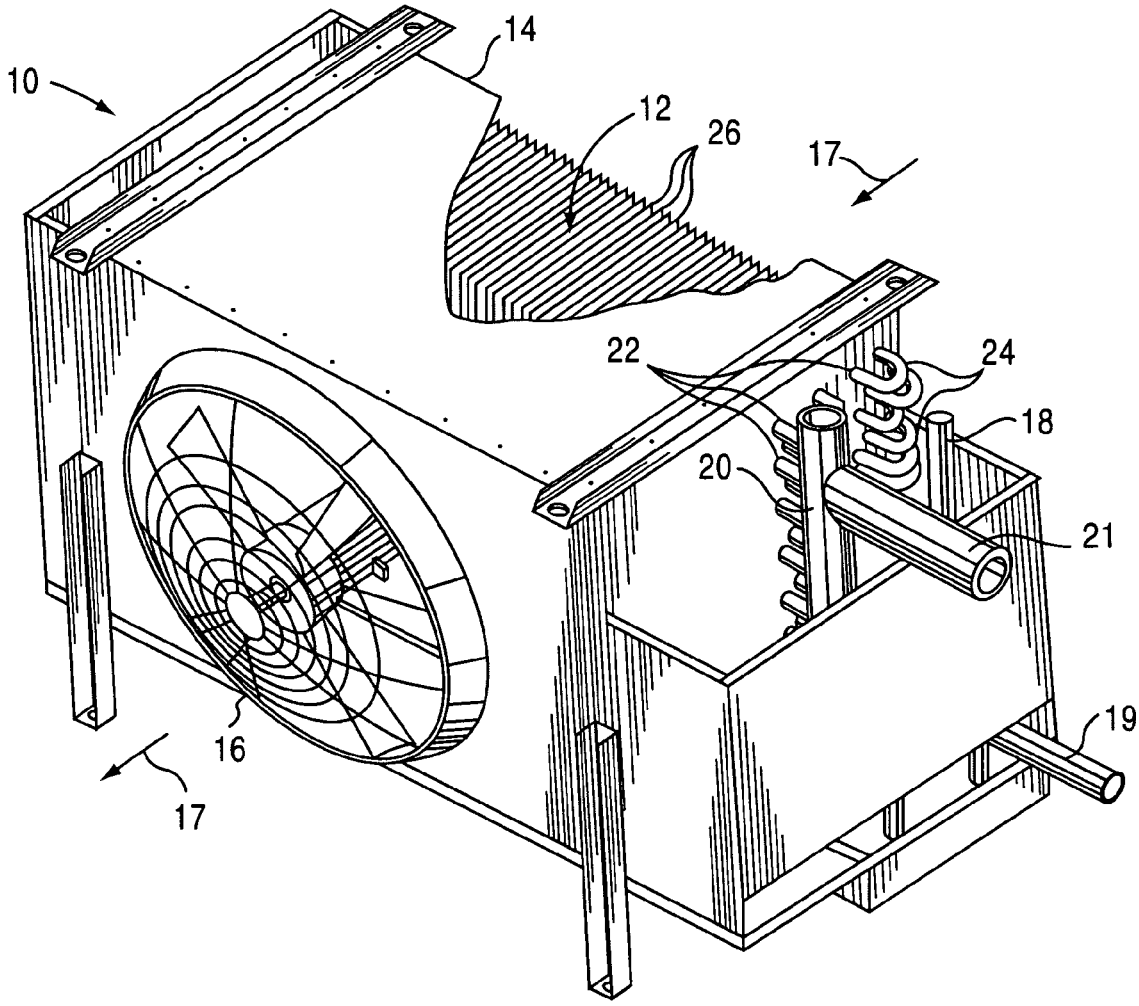
FIG.1 PRIOR ART
FIG. 1 is a perspective view of a conventional heat exchanger that includes a finned coil assembly, a housing covering the finned coil assembly and a blower among other conventional components.
Figure 2:
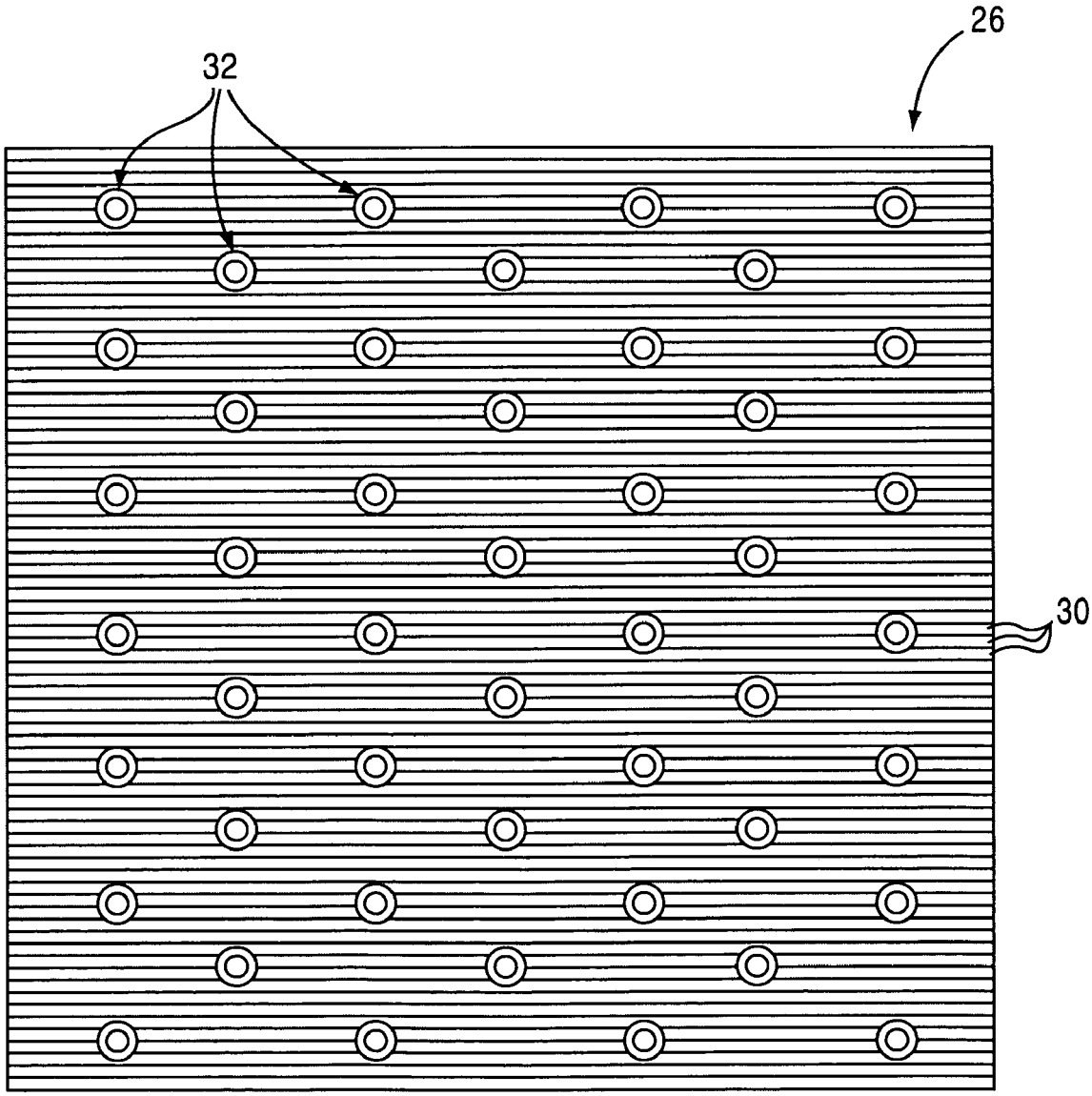
FIG.2 PRIOR ART
FIG. 2 is a front elevational view of a conventional high-frequency, low-amplitude corrugated fin.
Figure 3:
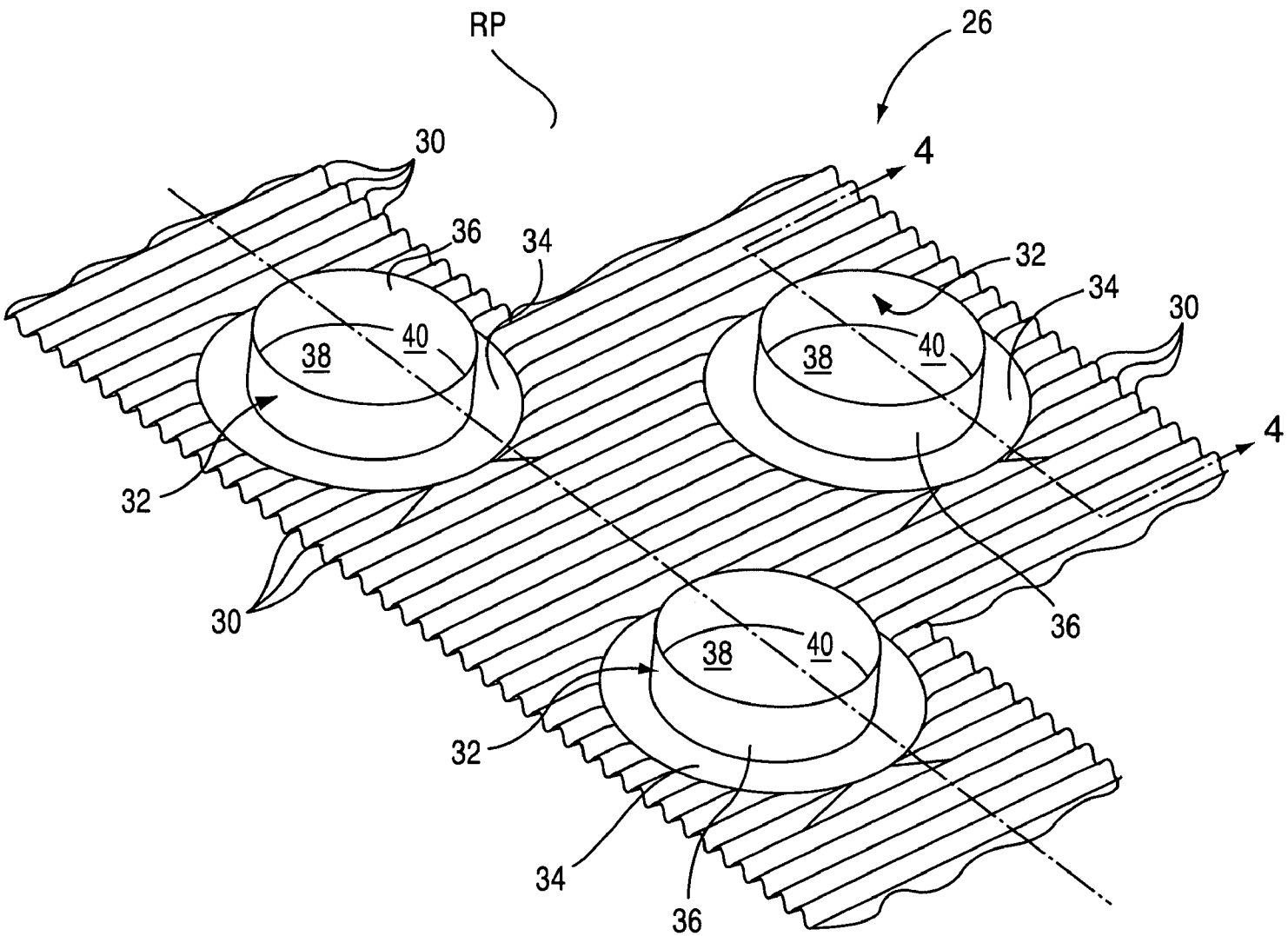
FIG.3 PRIOR ART
FIG. 3 is an enlarged partial perspective view of the corrugated fin in FIG. 2.
Figure 4:
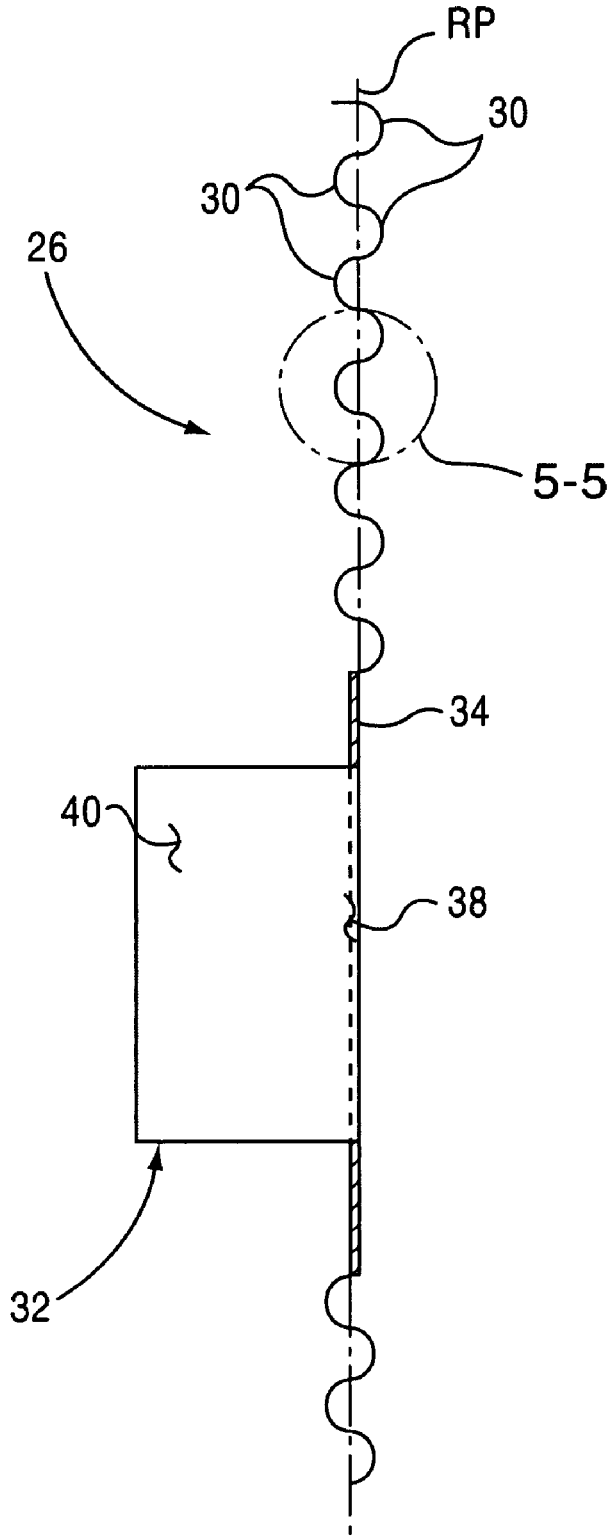
FIG.4 PRIOR ART
FIG. 4 is an enlarged partial side elevational view of the corrugated fin taken a long line 4-4 in FIG. 3.

Hereinafter, embodiments of the present invention will be described with reference to the attached drawings. The structural components common to those of the prior art and the structural components common to respective embodiments of the present invention will be represented by the same reference numerals and repeated description thereof is omitted.

Figure 10:
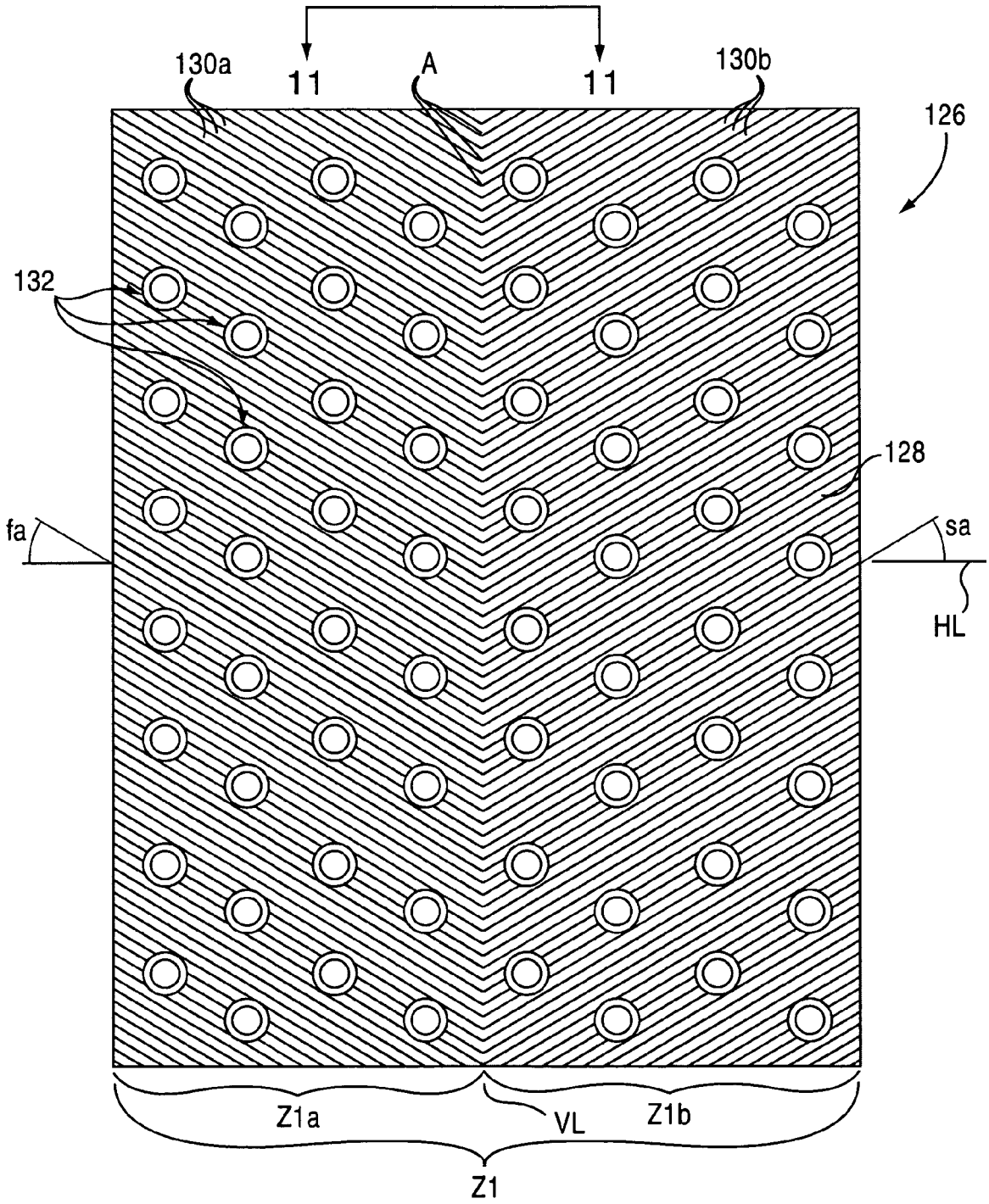
FIG. 10 is a front elevational view of a first exemplary embodiment of a high-frequency, low-amplitude corrugated fin of the present invention with a first series of corrugated segments and a second series of corrugated segments arranged in a chevron configuration.
Figure 11:
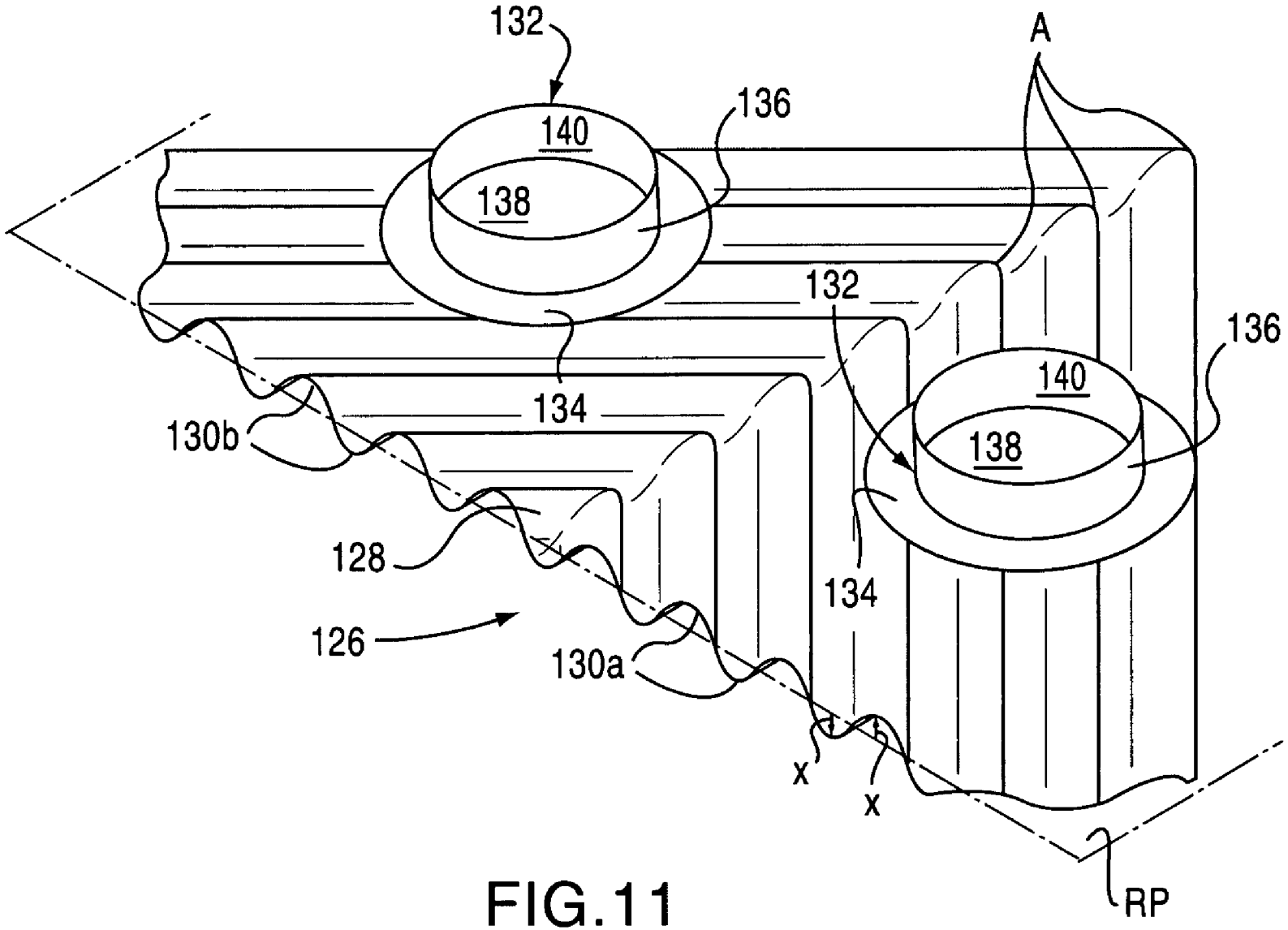
FIG. 11 is a partial perspective view of the corrugated fin of the present invention taken along line of 11-11 in FIG. 10.

A first exemplary embodiment of a high-frequency, low-amplitude corrugated fin 126 of the present invention for the finned coil assembly 12 is hereinafter described with reference to FIGS. 10 and 11. Rather than repetitively referring to the present invention as a high-frequency, low-amplitude corrugated fin, the present invention will be hereinafter referred to as "the fin". The fin 126 includes a plate member 128 that extends horizontally in a horizontal direction along horizontal line HL and vertically in a vertical direction along line VL to define the reference plane RP as best shown in FIG. 11. The plate member 128 has a plurality of conduit portions 132, a first series of corrugated segments 130*a* formed in the plate member 128 and a second series of corrugated segments 130*b* formed into the plate member 128. By way of example only and not by way of limitation, the first and second series of corrugated segments 130*a* and 130*b* of the first exemplary embodiment of the present invention respectively undulate generally equidistantly relative to and from the reference plane RP as viewed in cross-section and represented by distances "x" shown in FIG. 11. The plurality of conduit portions 132 is inter-dispersed throughout the plate member 128 among the first and second series of corrugated segments 130*a* and 130*b* as shown in FIG. 10. By way of example only and not by way of limitation, the plurality of conduit portions 132 are arranged in a plurality of vertical columns in which adjacent vertical columns are offset horizontally from one another.

Each conduit portion 132 has a flat piece 134 and a collar 136. Each flat piece 134 is generally disposed in the reference plane RP as best shown in FIG. 11 and has a hole 138 formed transversely therethrough. A respective collar 136 is connected to and projects from a corresponding one of the flat pieces 134 to define a transversely extending conduit 140 in communication with the hole 138.

Each one of the first series of corrugated segments 130*a* extends at a first angle fa relative to the horizontal line HL and each one of the second series of corrugated segments 130*b* extend at a second angle sa relative to the horizontal line HL. By way of example only and not by way of limitation, the first angle fa and the second angle sa are at least substantially equal to each other. In the first exemplary embodiment of the present invention, individual adjacent ones of the first and second series of corrugated segments 130*a* and 130*b* form a chevron-shaped configuration as viewed in plan view at approximately the horizontal center of the plate member 128. More specifically, the individual adjacent ones of the first and second series of corrugated segments 130*a* and 130*b* are integrally connected together at adjacent opposing ends to form an apex A at each connection location. A skilled artisan would appreciate that, for the first exemplary embodiment of the fin 126 of the present invention, sequential individual adjacent ones of the first and second series of corrugated segments 130*a* and 130*b* form V-shaped corrugations representing a series of chevron configurations.

It is considered that the plate member 128 of the fin 126 of the first exemplary embodiment of the present invention has one zone Z1. The one zone Z1 of the plate member 128 has a first sub-zone Z1*a* and a second sub-zone Z1*b*. The first sub-zone Z1*a* is defined by the first series of corrugated segments 130*a* that includes four vertical columns of conduit portions 132 and the second sub-zone Z1*b* is defined by the second series of corrugated segments 130*b* disposed juxtaposed to the first sub-zone Z1*a* that includes four vertical columns of conduit portions 132.

Note, in the event that condensation accumulates on the corrugations 130*a* and 130*b* sufficient to form running water, the running water would tend to migrate toward the vertical center of the fin 126 represented by the vertical line VL and water accumulating towards the vertical center of the fin 126 would drain downwardly therefrom at respective ones of the apexes A.

Figure 12:
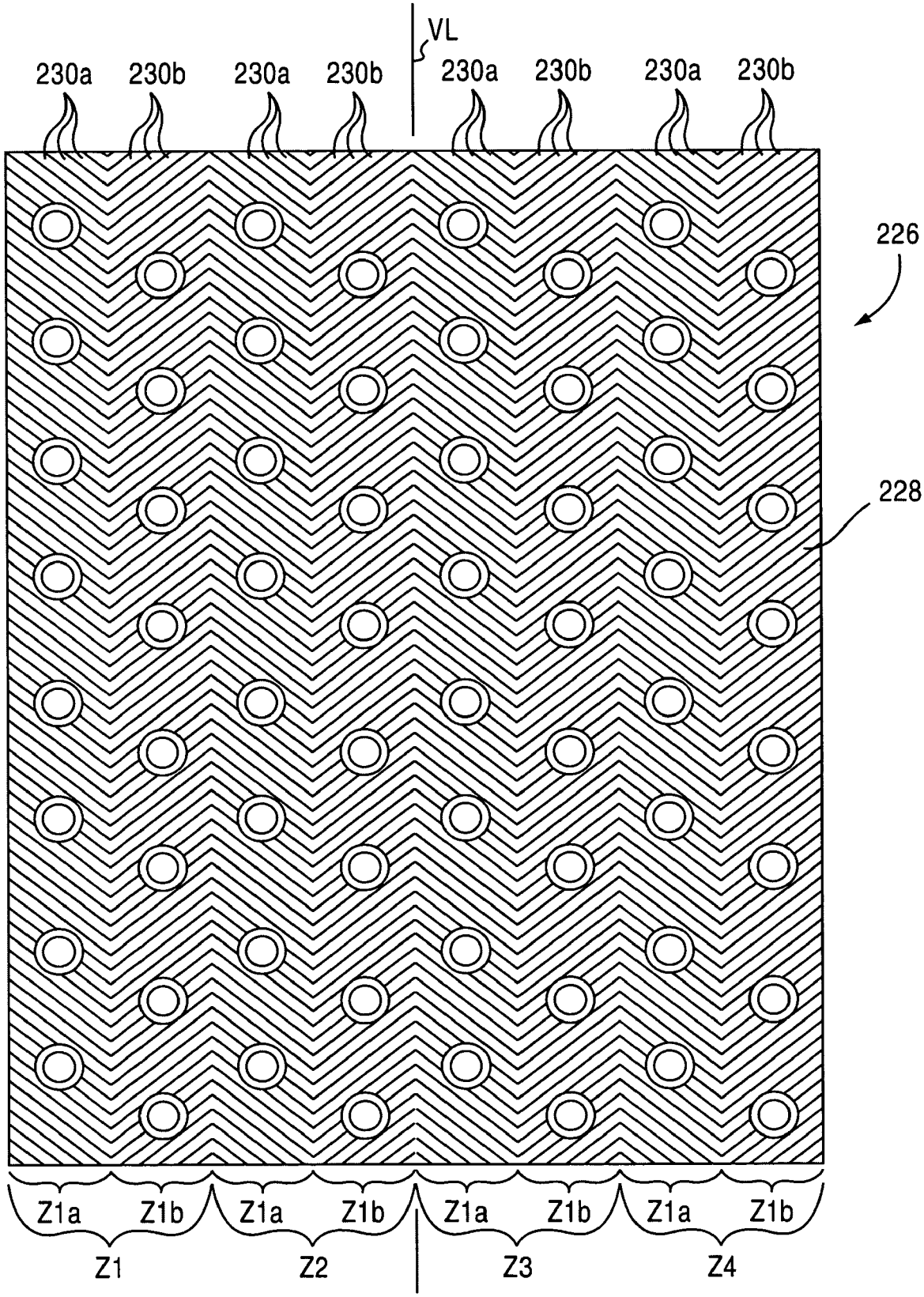
FIG. 12 is a front elevational view of a second exemplary embodiment of a high-frequency, low-amplitude corrugated fin of the present invention with multiple first series of corrugated segments and multiple second series of corrugated segments arranged in multiple chevron configurations.

A second exemplary embodiment of a fin 226 of the present invention for the finned coil assembly 12 is illustrated in FIG. 12. The second exemplary embodiment of the fin 226 is similar to the first exemplary embodiment of the fin 126 except that the fin 226 of second exemplary embodiment has sequential individual adjacent ones of the first and second series of corrugated segments 230*a* and 230*b* form an alternating sequence of V-shaped and inverted V-shaped corrugations and can be considered to have a plurality of zones Z1 through Z4. However, one of ordinary skill in the art would appreciate that the fin 226 of the present invention might have a plurality of zones Z1 through Zn.

The plate member 226 has a series of juxtaposed zones Z1 through Z4 with individual ones of the first series of corrugated segments 230*a* in the first sub-zone Z1*a* of each one of the series of juxtaposed zones Z1 through Z4 and individual ones of the second series of corrugated segments 230*b* in the second sub-zone Z1*b* of each one of the series of juxtaposed zones Z1 through Z4 adjacent to the individual ones of the first series of corrugated segments 230*a* in the first sub-zone Z1 are oriented relative to one another to define a series of V-shaped corrugations representing a series of chevron configurations.

Although not by way of limitation, the first sub-zone Z1*a* is defined by the first series of corrugated segments 230*a* that includes one vertical column of conduit portions 132 and the second sub-zone Z1*b* defined by the second series of corrugated segments 130*b* disposed juxtaposed to the first sub-zone Z1*a* includes one vertical column of conduit portions 132.

Figure 13:
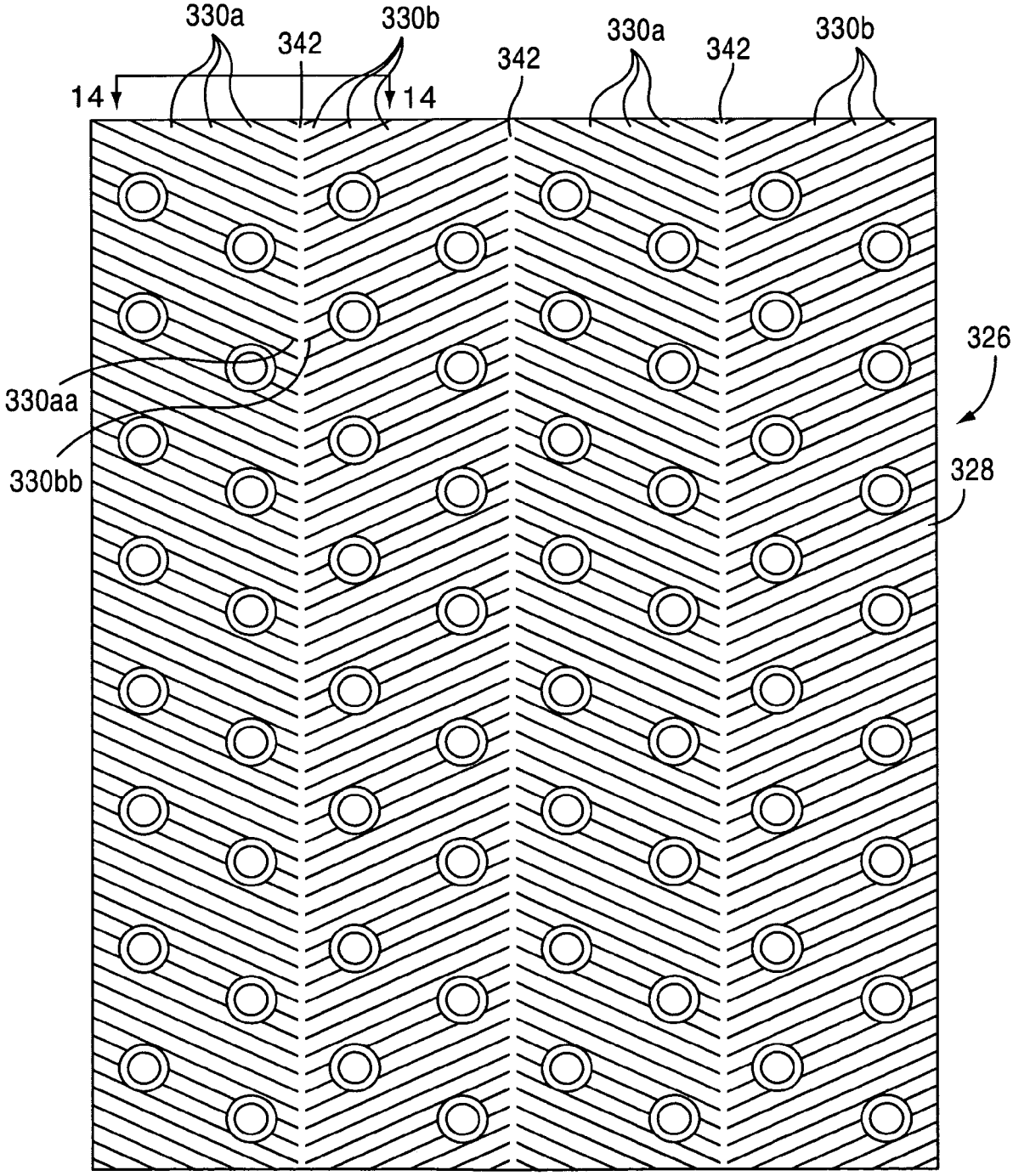
FIG. 13 is a front elevational view of a third exemplary embodiment of a high-frequency, low-amplitude corrugated fin of the present invention with multiple first series of corrugated segments and multiple second series of corrugated segments arranged in multiple general chevron configurations.
Figure 14:
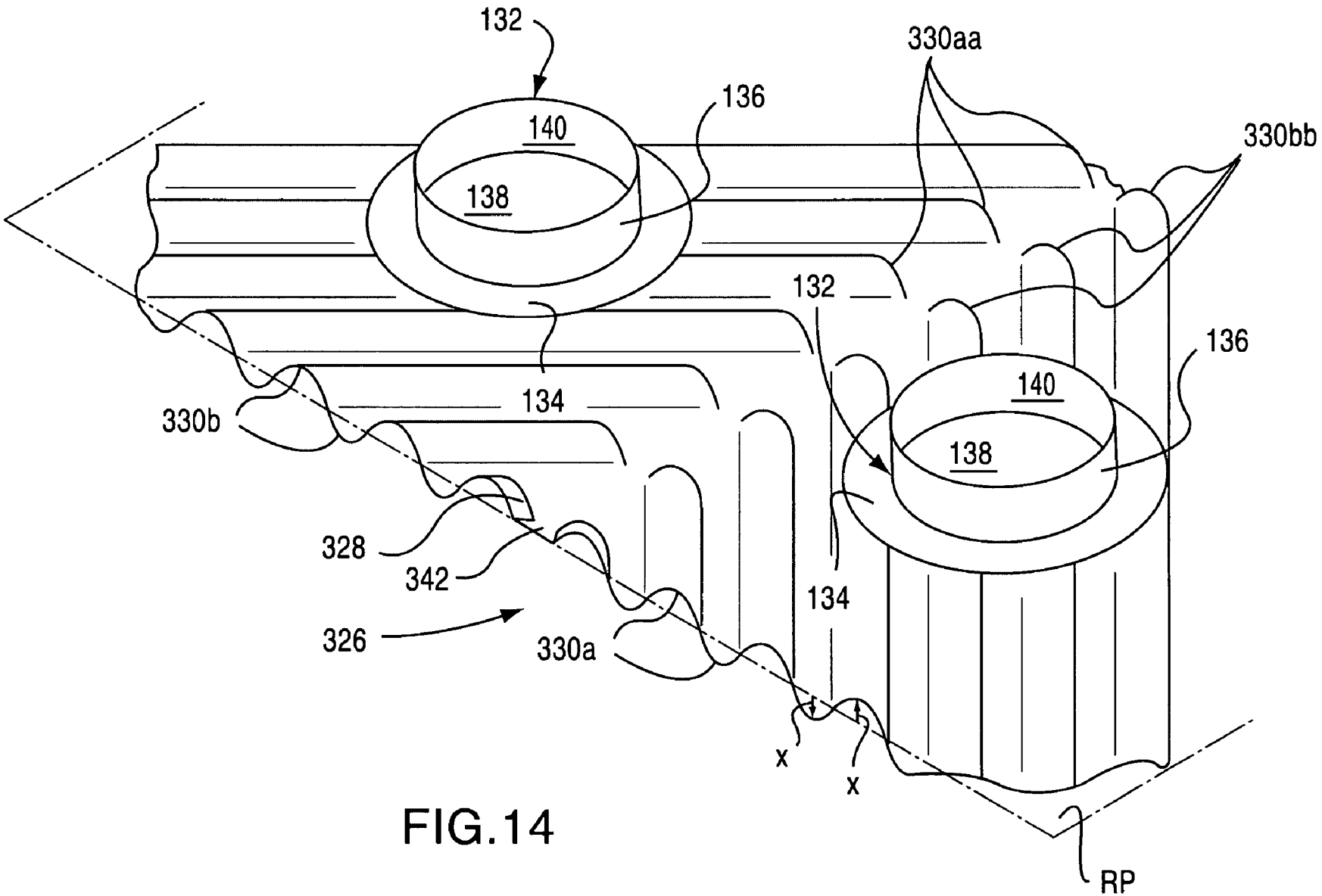
FIG. 14 is a partial perspective view of the corrugated fin of the present invention taken along line of 14-14 in FIG. 13.

A third exemplary embodiment of a fin 326 of the present invention is illustrated in FIGS. 13 and 14. The fin 326 includes a plate member 328 with individual adjacent ones of the first and second series of corrugated segments 330*a* and 330*b* being disposed apart from one another at adjacent opposing ends 330*aa* and 330*bb*. In this embodiment, the plate member 328 includes a flat strip element 342. Although by way of example only and not by way of limitation, the flat strip element 342 is disposed in the reference plane RP and extends vertically as well as horizontally between the individual adjacent ones of the first and second series of corrugated segments 330*a* and 330*b* respectively between the adjacent opposing ends 330*aa* and 330*bb*. Even though the flat strip element 342 is disposed between the individual adjacent ones of the first and second series of corrugated segments 330*a* and 330*b*, the individual adjacent ones of the first and second series of corrugated segments 330*a* and 330*b* form a substantially chevron-shaped configuration as viewed in plan view in that the non-contacting adjacent opposing ends 330*aa* and 330*bb* do not form an apex. Thus, the term "substantially chevron-shaped" shall be defined as including "chevron-shaped" where the adjacent opposing ends 330*aa* and 330*bb* contact each other to form apexes as well as the configuration described immediately hereinabove where the non-contacting adjacent opposing ends do not contact each other but are disposed apart from yet relatively close to one another. Also, other "substantially chevron-shaped" adjacent ones of the first and second series of corrugated segments are illustrated by way of example only in FIGS. 21-23.

Figure 15:
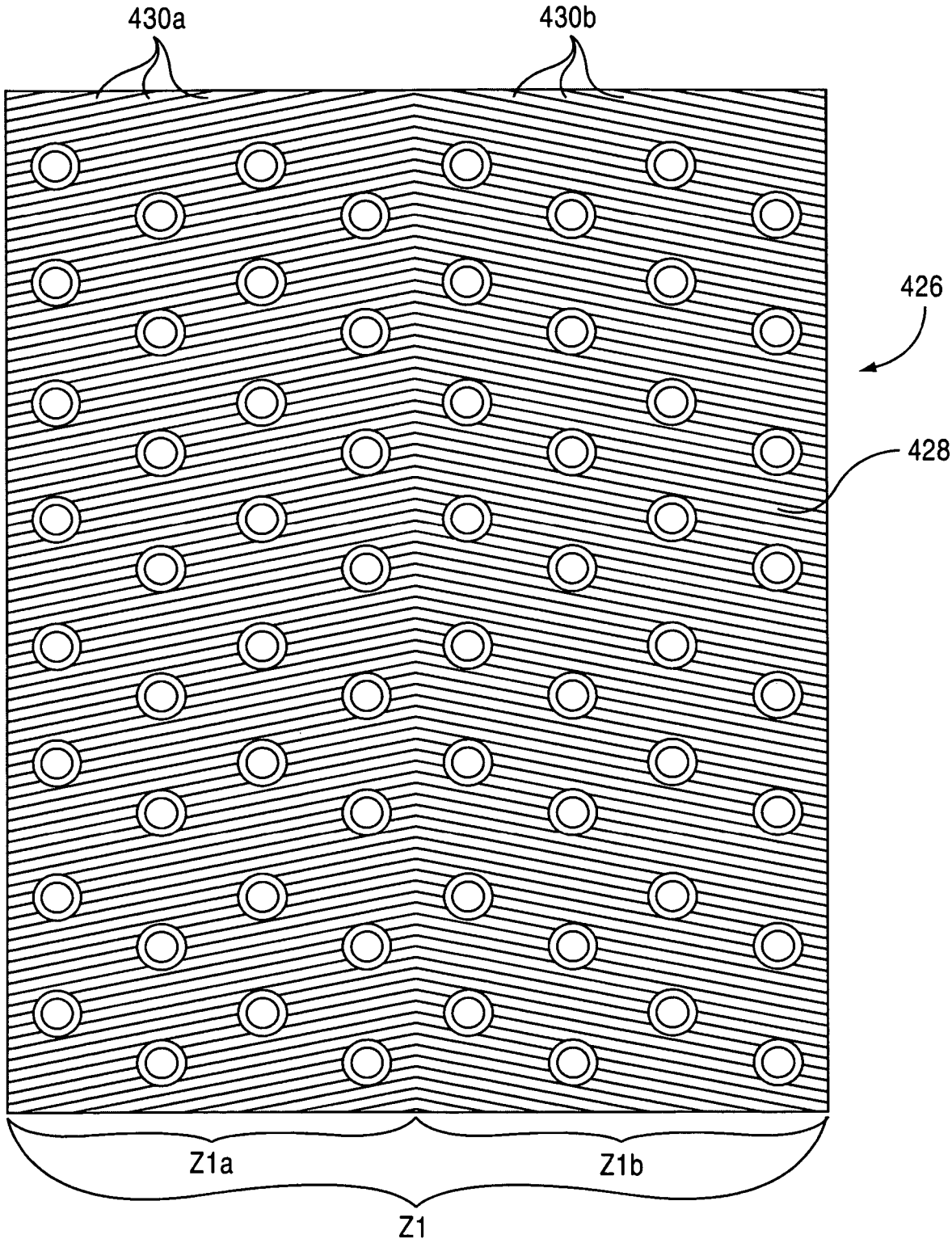
FIG. 15 is a front elevational view of a fourth exemplary embodiment of a high-frequency, low-amplitude corrugated fin of the present invention with a first series of corrugated segments and a second series of corrugated segments arranged in an inverted chevron configuration.

A fourth exemplary embodiment of a fin 426 of the present invention is illustrated in FIG. 15. A plate member 428 of the fourth exemplary embodiment of the fin 426 of the present invention is similar to the first embodiment of the fin 126 shown in FIG. 10 except that the first and second series of corrugated segments 430*a* and 430*b* respectively define inverted V-shapes or inverted chevron-shapes.

Figure 16:
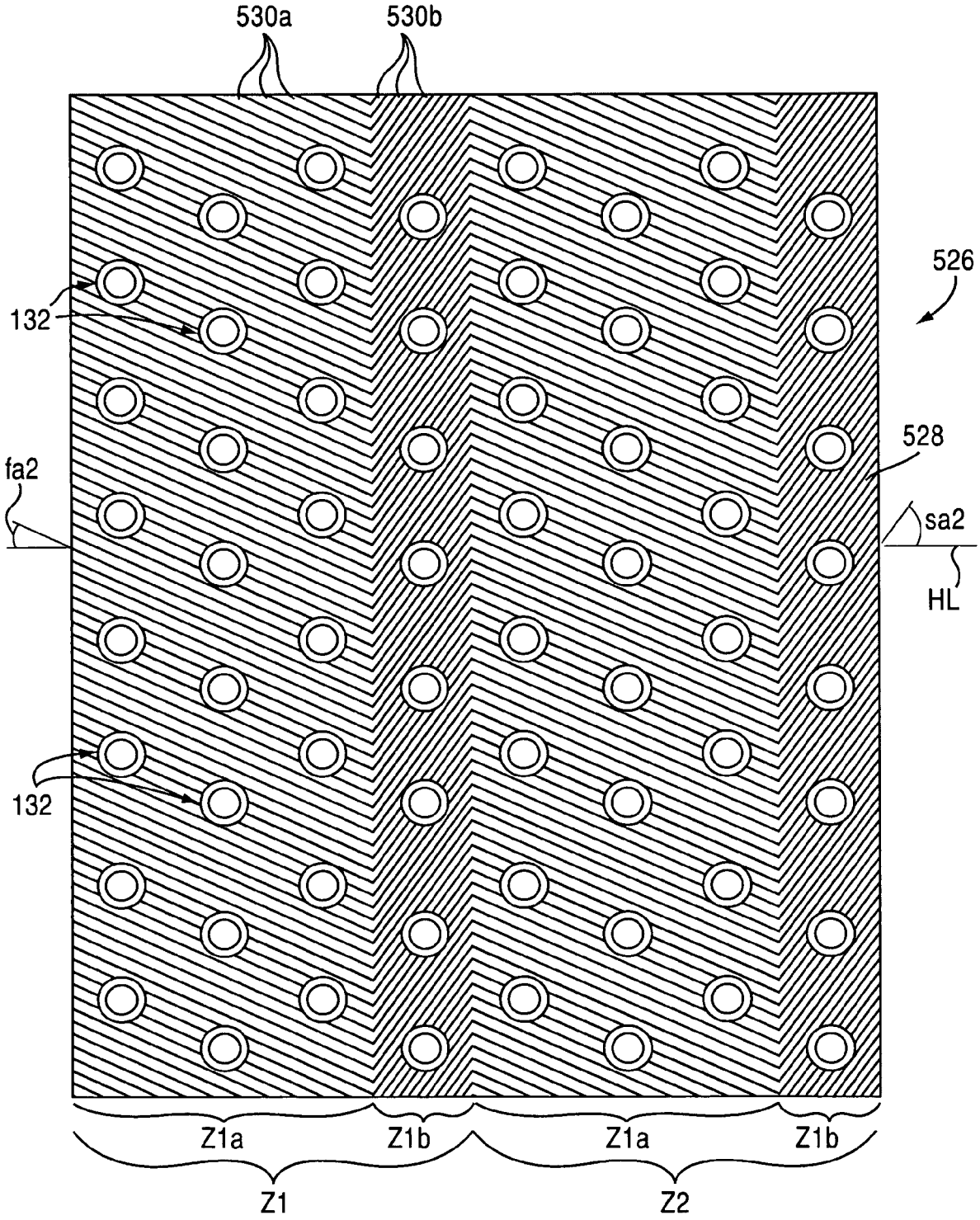
FIG. 16 is a front elevational view of a fifth exemplary embodiment of a high-frequency, low-amplitude corrugated fin of the present invention with multiple first series of corrugated segments and multiple second series of corrugated segments arranged in skewed chevron configurations.

A fifth exemplary embodiment of a fin 526 of the present invention is illustrated in FIG. 16. A plate member 528 of the fifth exemplary embodiment of the fin 526 of the present invention is somewhat similar to the first exemplary embodiment of the fin 126 shown in FIG. 10 and the fourth exemplary embodiment of the fin 426 shown in FIG. 15 except that the first and second series of corrugated segments 530*a* and 530*b* respectively define skewed V-shapes or skewed chevron shapes. Note that the first series of corrugated segments 530*a* extend at a first angle fa2 relative to the horizontal line HL and each one of the second series of corrugated segments 530*b* extend at a second angle sa2 relative to the horizontal line HL. One of ordinary skill in the art would appreciate the first angle fa2 is different from the second angle sa2 and, in this particular case by way of example only, the first angle fa2 is less than the second angle sa2. Also, zone Z1 includes four vertical columns of conduit portions 132 with adjacent ones of the vertical columns of conduit portions 132 being horizontally offset from one another while sub-zone Z1*a* has three vertical columns of conduit portions 132 and sub-zone Z1*b* has one vertical column of conduit portions 132.

Figure 17:
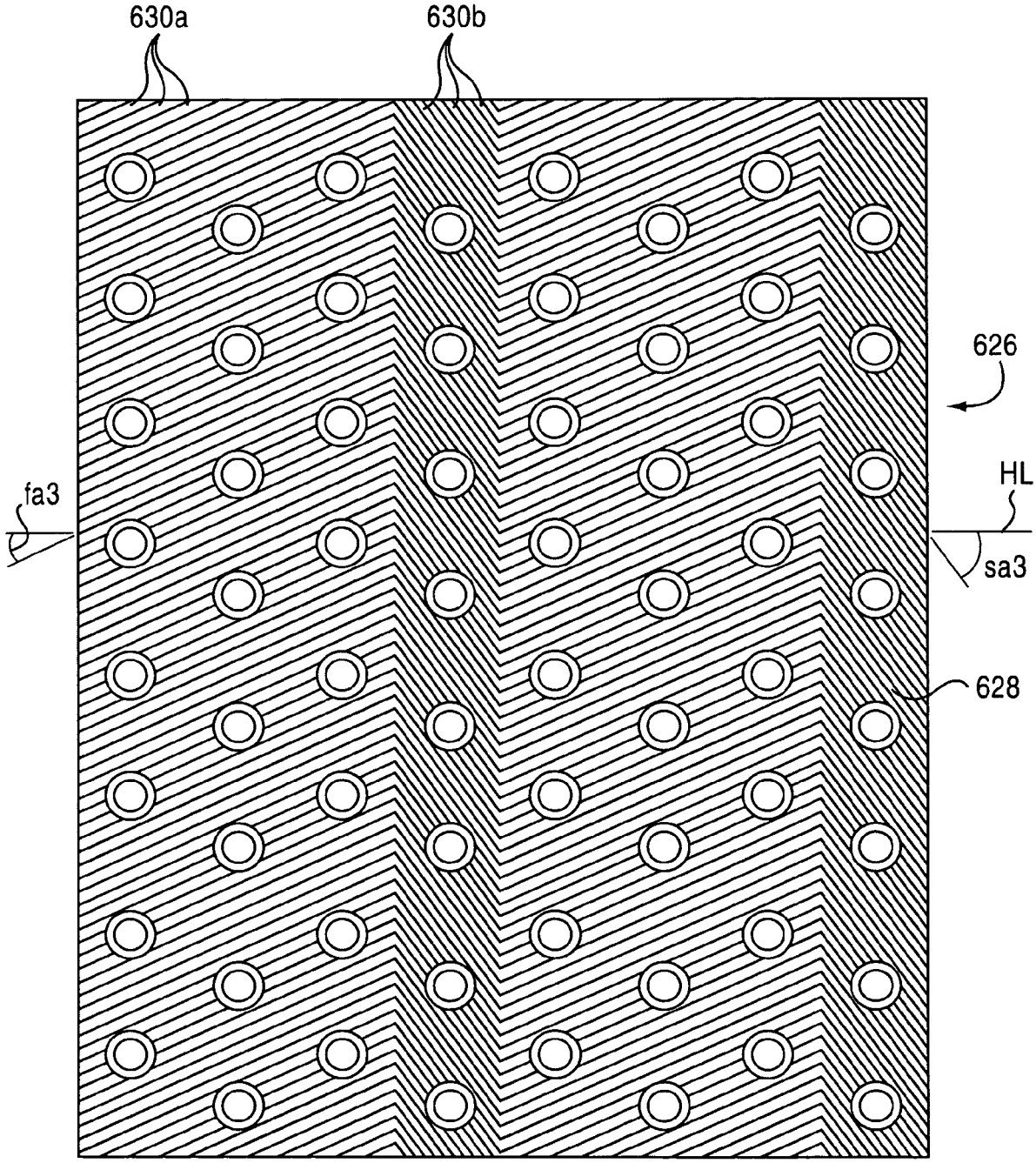
FIG. 17 is a front elevational view of a sixth exemplary embodiment of a high-frequency, low-amplitude corrugated fin of the present invention with multiple first series of corrugated segments and multiple second series of corrugated segments arranged in inverted, skewed chevron configurations.

A sixth exemplary embodiment of a fin 626 of the present invention is illustrated in FIG. 17. A plate member 628 of the sixth exemplary embodiment of the fin 626 of the present invention is similar to the fifth exemplary embodiment of the fin 526 shown in FIG. 15 except that the first and second series of corrugated segments 630*a* and 630*b* define inverted skewed V-shapes or inverted chevron shapes. Note that the of the first series of corrugated segments 630*a* extends at a first angle fa3 relative to the horizontal line HL and each one of the second series of corrugated segments 630*b* extend at a second angle sa3 relative to the horizontal line HL. One of ordinary skill in the art would appreciate the first angle fa3 is different from the second angle sa3 and, in this particular case by way of example only, the first angle fa3 is less than the second angle sa3.

Figure 18:
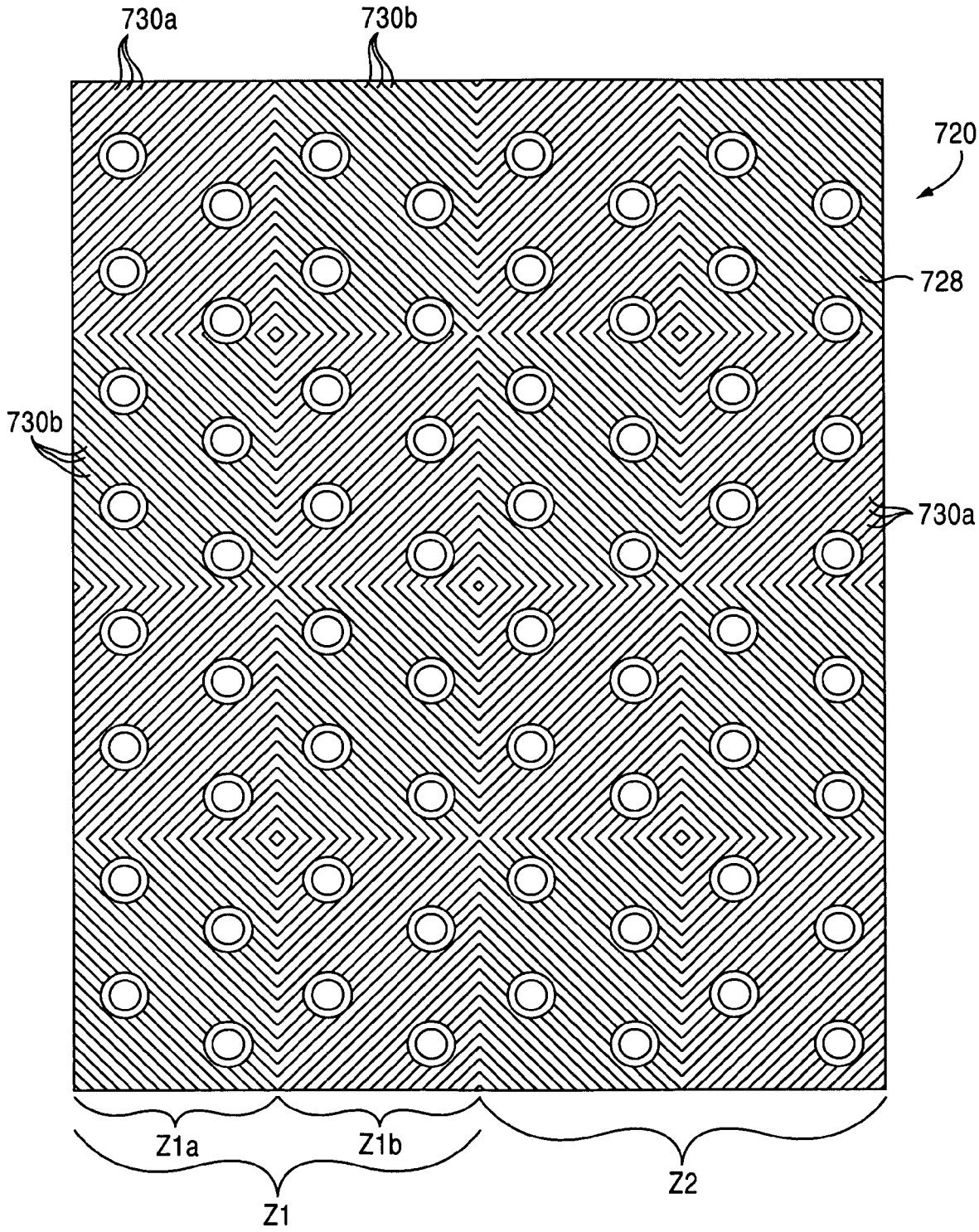
FIG. 18 is a front elevational view of a seventh exemplary embodiment of a high-frequency, low-amplitude corrugated fin of the present invention with multiple first series of corrugated segments and multiple second series of corrugated segments arranged in an alternating combination of V-shapes and inverted V-shapes forming multiple diamond patterns.

A seventh exemplary embodiment of a fin 726 of the present invention is illustrated in FIG. 18. A plate member 728 of the seventh exemplary embodiment of the fin 726 of the present invention has two series of juxtaposed zones Z1 and Z2 with individual ones of the first series of corrugated segments 730*a* in the first sub-zone Z1*a* of each one of the series of juxtaposed zones Z1 and Z2 and individual ones of the second series of corrugated segments 730*b* in the second sub-zone Z1*b* of each one of the series of juxtaposed zones Z1 and Z2 adjacent to the individual ones of the first series of corrugated segments Z1*a* in the first sub-zone are oriented relative to one another to define an alternating combination of V-shapes (or chevron shapes) and inverted V-shapes (or inverted chevron shapes). By way of example only, the combination of V-shapes and inverted V-shapes in each zone Z1 and Z2 yields multiple diamond patterns.

Figure 19:
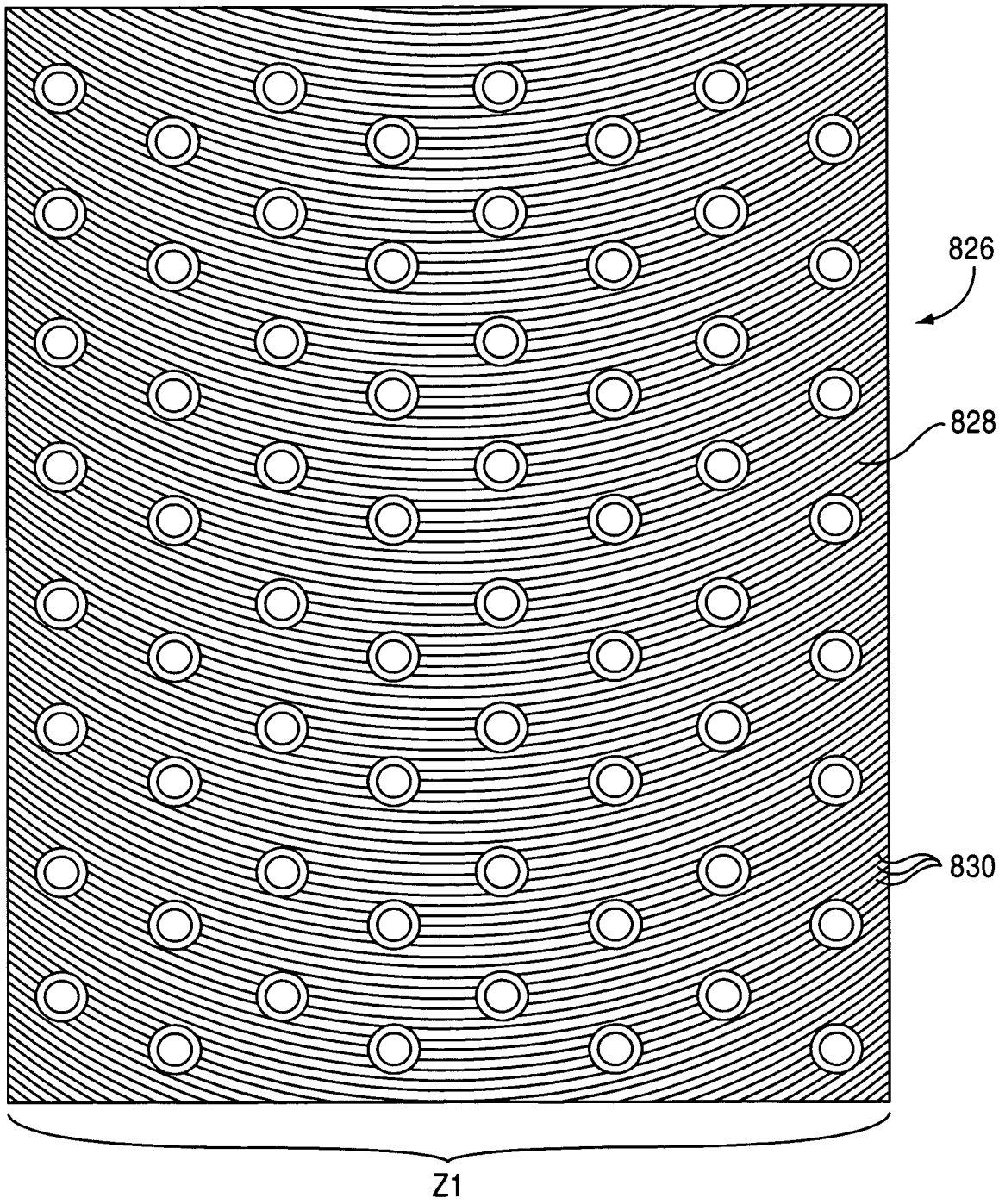
FIG. 19 is a front elevational view of an eighth exemplary embodiment of a high-frequency, low-amplitude corrugated fin of the present invention with a plate member having a single zone with a single series of arcuate-shaped corrugated segments.

An eighth exemplary embodiment of a fin 826 of the present invention is illustrated in FIG. 19. The eighth exemplary embodiment of the fin 826 is similar to the ones discussed above. The difference is that a plate member 828 has a single zone Z1 with a single series of arcuate-shaped corrugated segments 830.

Figure 20:
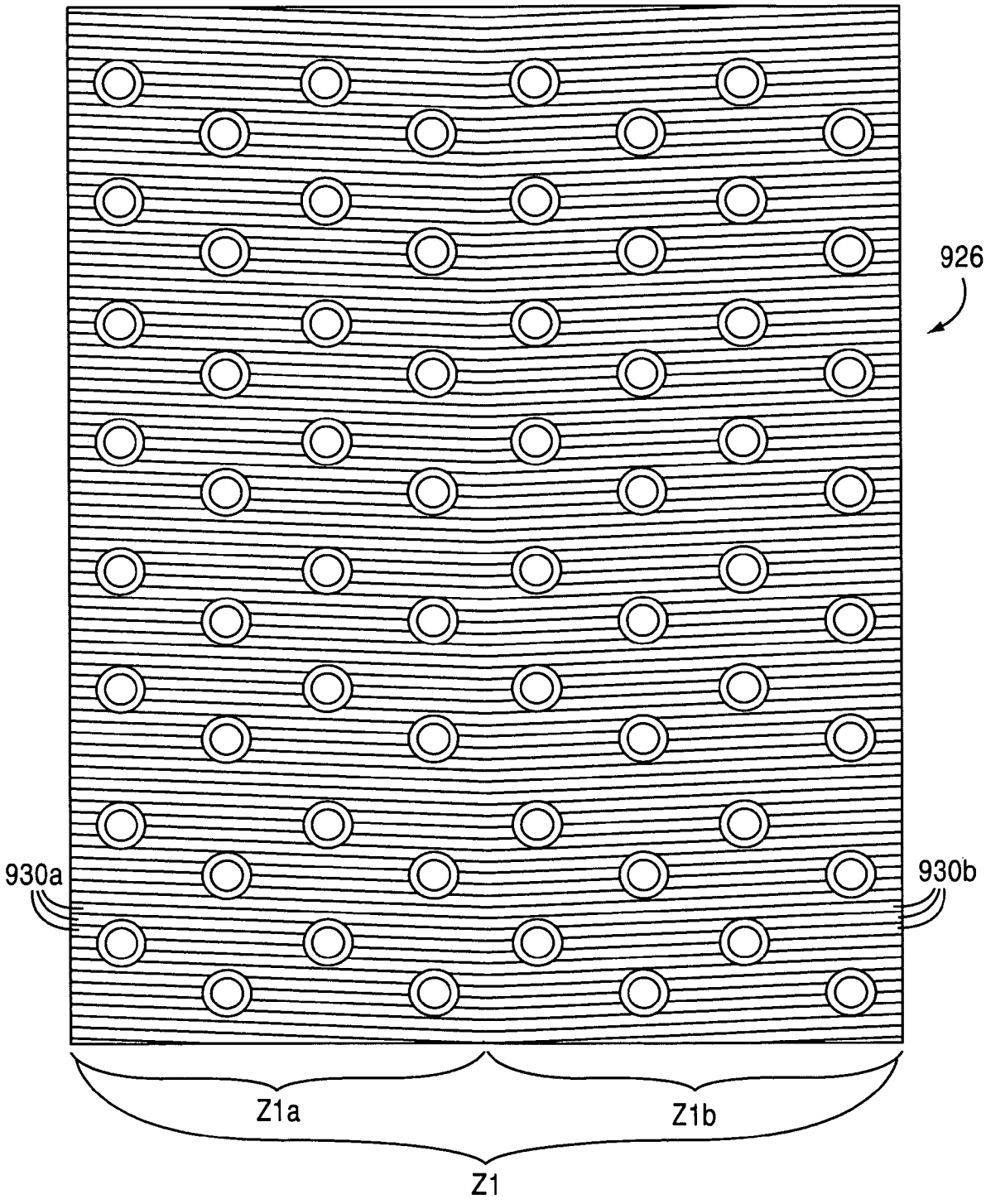
FIG. 20 is a front elevational view of a ninth exemplary embodiment of a high-frequency, low-amplitude corrugated fin of the present invention with a first series of corrugated segments and a second series of corrugated segments arranged in a chevron configuration as shown in FIG. 10 with a lower pitch.

A ninth exemplary embodiment of a high-frequency, low-amplitude corrugated fin 926 of the present invention is illustrated in FIG. 20. Note that a first series of corrugated segments 930*a* and a second series of corrugated segments 930*b* are arranged in a chevron configuration similar as to what is shown in FIG. 10 except that the first series of corrugated segments 930*a* and a second series of corrugated segments 930*b* have a lower pitch.

Figure 21A:
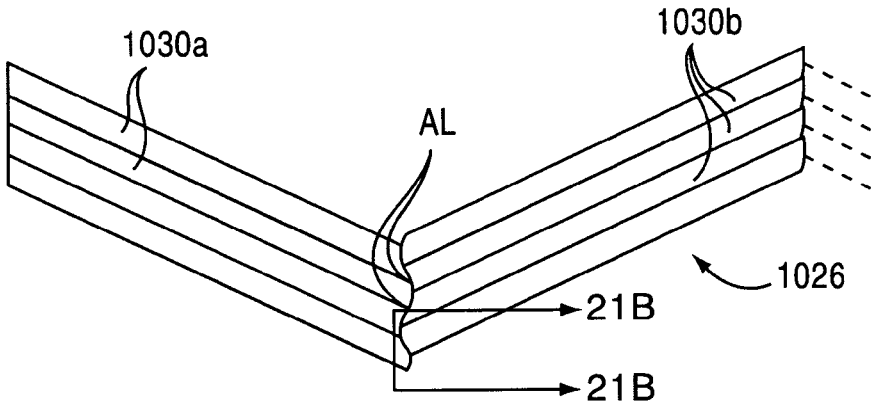
FIG. 21A is a front elevational view of a tenth exemplary embodiment of a high-frequency, low-amplitude corrugated fin of the present invention with a first series of corrugated segments and a second series of corrugated segments arranged in a substantially chevron-shaped configuration that are intentionally and vertically misregistered with one another.
Figure 21B:
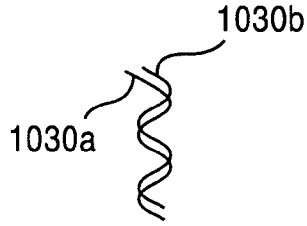
FIG. 21B is a partial cross-sectional view of the high-frequency, low-amplitude corrugated fin of the present invention taken along line 21-21 in FIG. 21.

A tenth exemplary embodiment of a high-frequency, low-amplitude corrugated fin 1026 of the present invention is illustrated in FIGS. 21A and 21B. A first series of corrugated segments 1030*a* and a second series of corrugated segments 1030*b* are arranged in a substantially chevron-shaped configuration but are intentionally and vertically misregistered with one another at respective apex locations AL.

Figure 22:
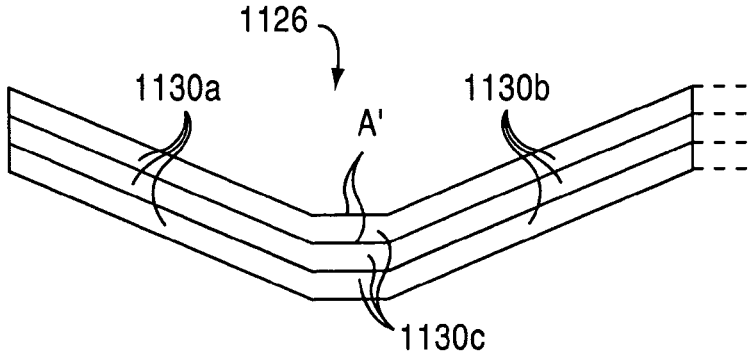
FIG. 22 is a front elevational view of a eleventh exemplary embodiment of a high-frequency, low-amplitude corrugated fin of the present invention with a first series of corrugated segments and a second series of corrugated segments arranged in a substantially chevron-shaped configuration with a horizontal corrugation segment in lieu of a pointed apex.

An eleventh exemplary embodiment of a high-frequency, low-amplitude corrugated fin 1126 of the present invention is illustrated in FIG. 22. A first series of corrugated segments 1130*a* and a second series of corrugated segments 1130*b* are arranged in a substantially chevron-shaped configuration with a series of horizontal corrugation segments 1130*c* that represent flattened apexes A'.

Figure 23:
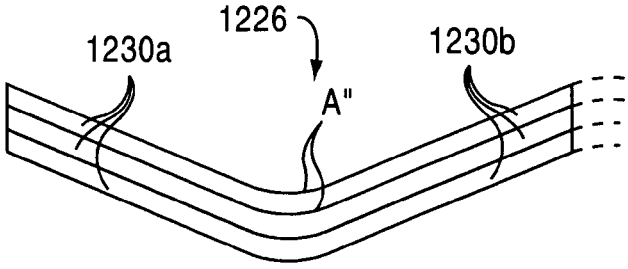
FIG. 23 is a front elevational view of a twelfth exemplary embodiment of a high-frequency, low-amplitude corrugated fin of the present invention with a first series of corrugated segments and a second series of corrugated segments arranged in a substantially chevron-shaped configuration with an arcuate apex.

A twelfth exemplary embodiment of a high-frequency, low-amplitude corrugated fin 1226 of the present invention is illustrated in FIG. 23. A first series of corrugated segments 1230*a* and a second series of corrugated segments 1230*b* are arranged in a substantially chevron-shaped configuration with a series of arcuate apexes A".

Figure 5:
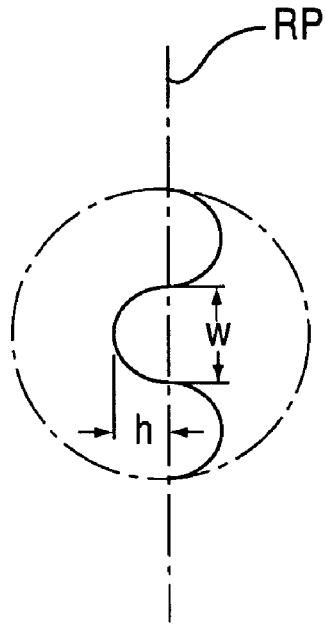
FIG.5 PRIOR ART
FIG. 5 is an enlarged partial side elevational view of the corrugated fin taken a long line 5-5 in FIG. 4.
Figure 6:
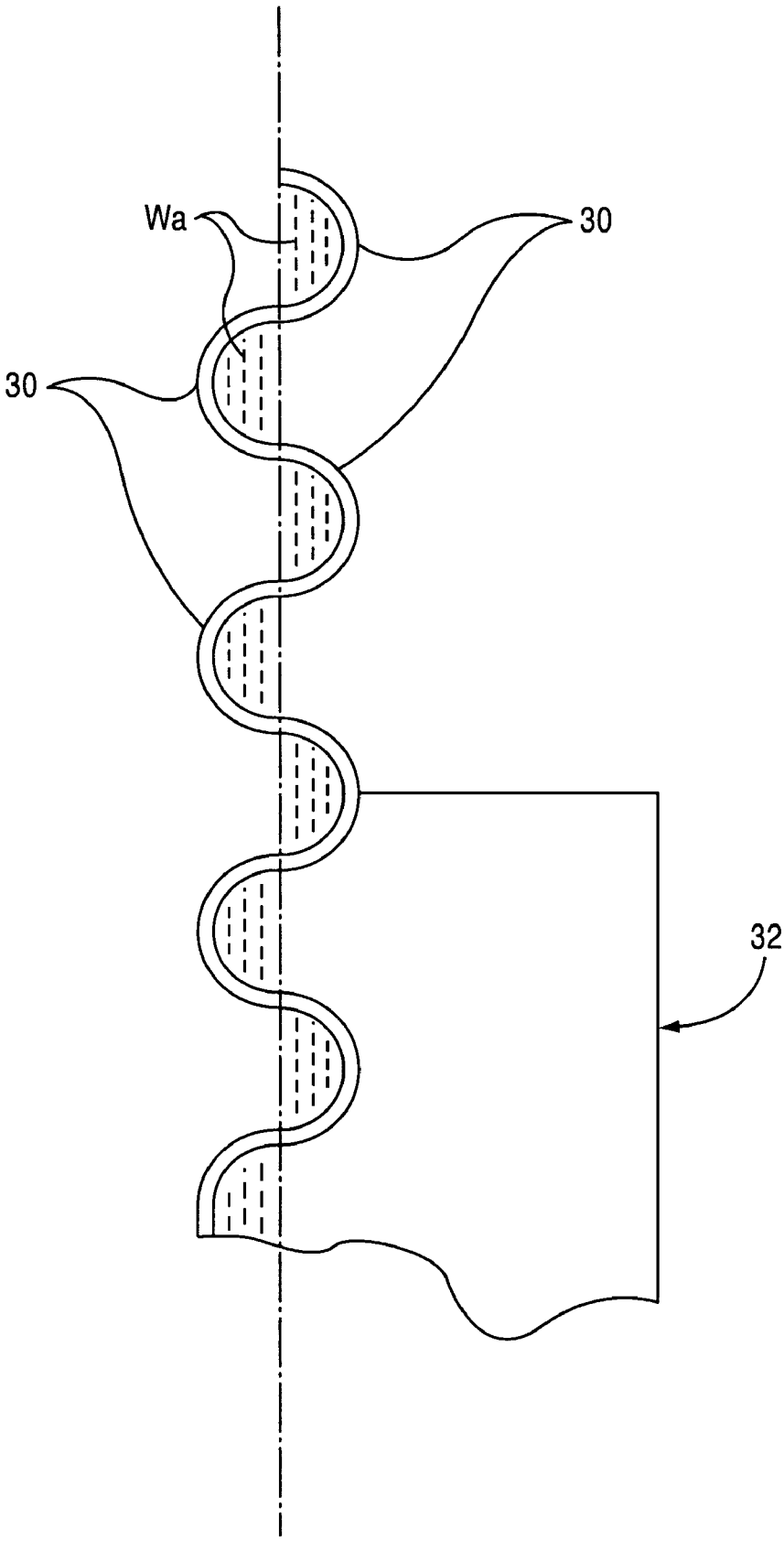
FIG.6 PRIOR ART
FIG. 6 is an enlarged partial side elevational view of the corrugated fin in FIG. 4 with water contained within the valleys of the corrugations.
Figure 7:
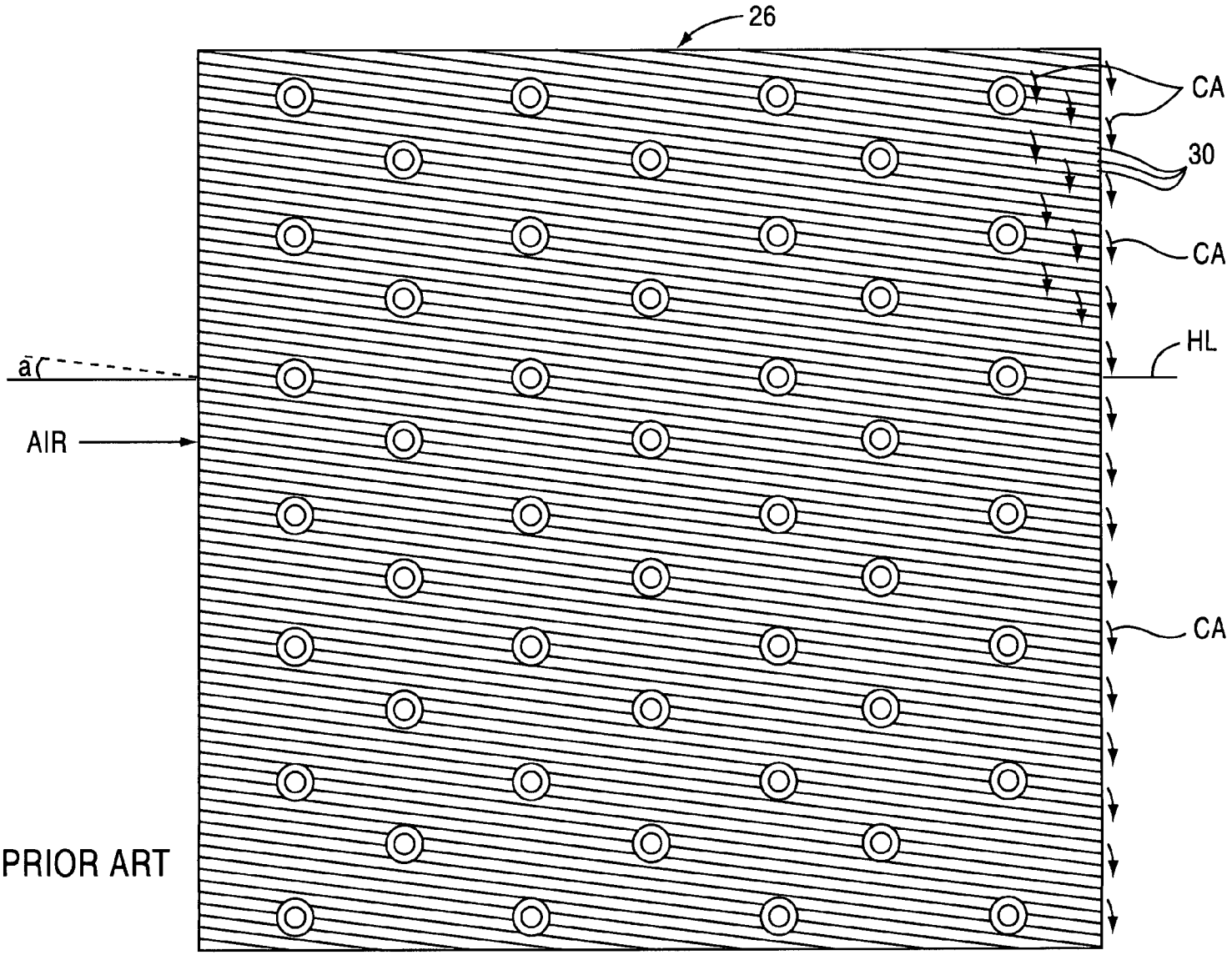
FIG.7 PRIOR ART
FIG. 7 is a front elevational view of another conventional high-frequency, low-amplitude corrugated fin with its corrugations inclined at an angle.
Figure 8:
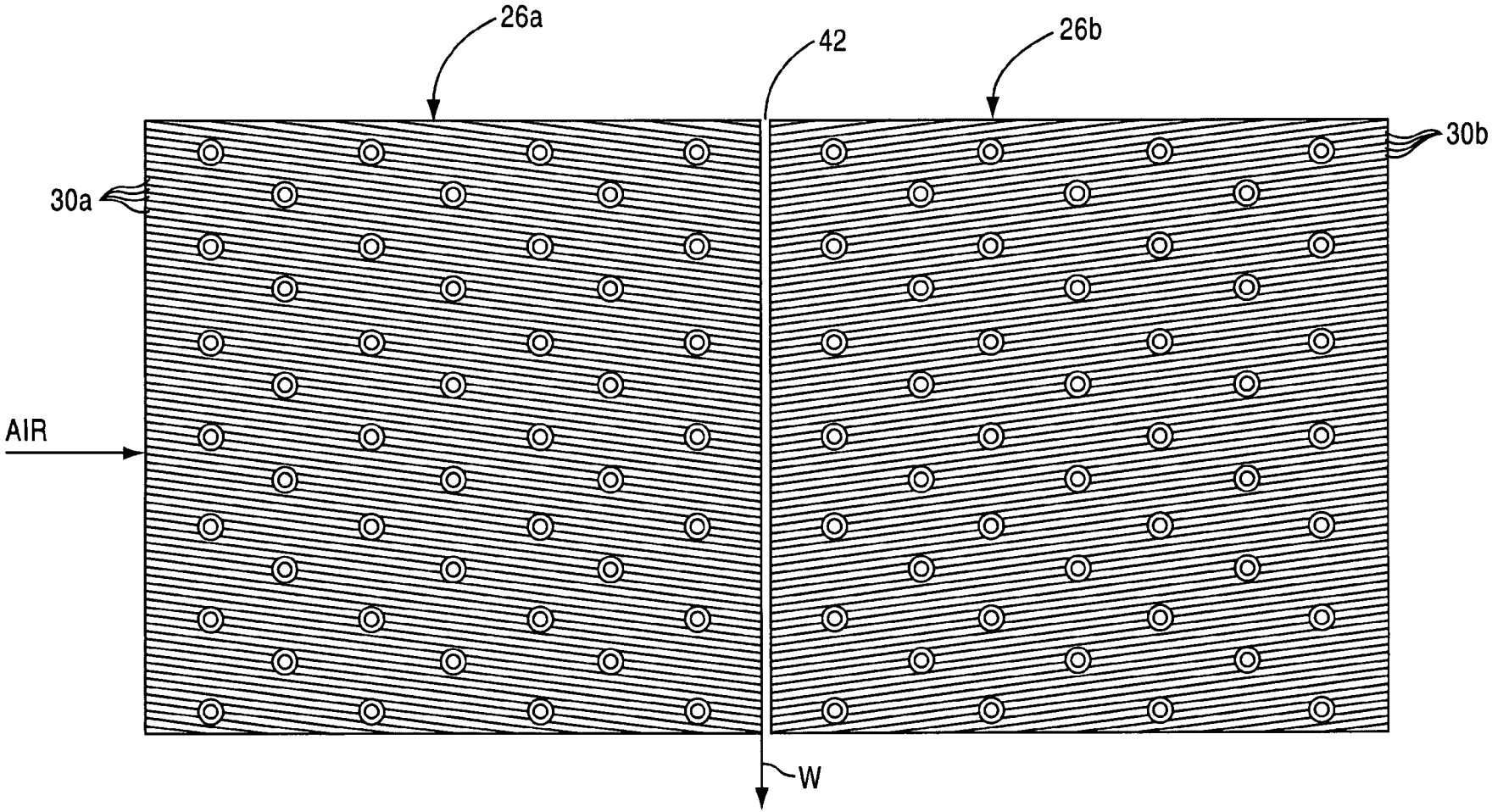
FIG.8 PRIOR ART
FIG. 8 is a front elevational view of two corrugated fins with corrugations inclined at an angle disposed adjacent to one another.
Figure 9A:
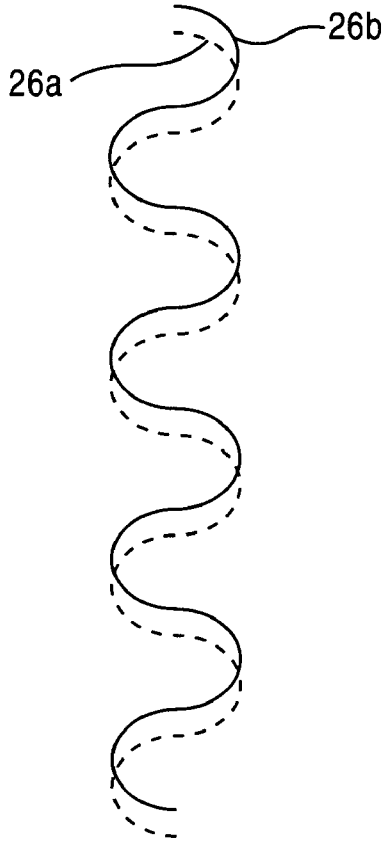
FIG.9A PRIOR ART
FIG. 9A is a diagrammatic view of the two corrugated fins in FIG. 8 illustrating an overlapping offset registration relative to one another.
Figure 9B:
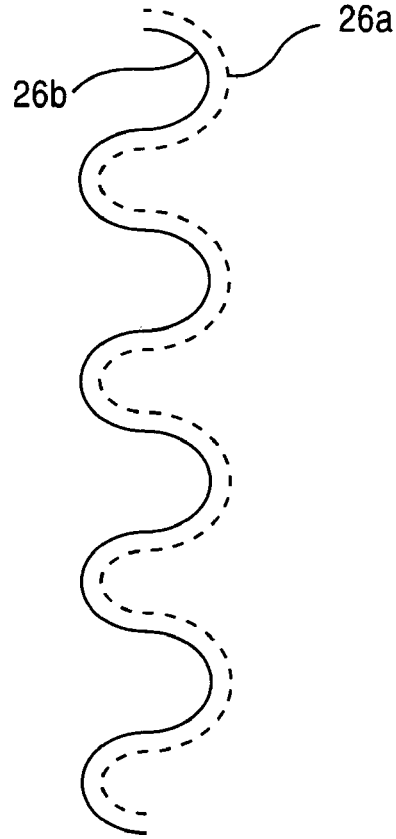
FIG.9B PRIOR ART
FIG. 9B is a diagrammatic view of the two corrugated fins in FIG. 8 illustrating a side-by-side offset registration relative to one another.

It is appreciated by one of ordinary skill in the art that the above exemplary embodiments of the fin are not limited to the specific features set forth in the drawing figures. For example, at least one zone has a first sub-zone defined by the first series of corrugated segments that includes at least one vertical column of conduit portions and a second sub-zone defined by the second series of corrugated segments disposed juxtaposed to the first sub-zone that includes at least one vertical column of conduit portions. Also, each one of the first and second series of corrugated segments projects from the reference plane as viewed in cross-section at a height h and extends along the reference plane as viewed in cross-section at a width w and a ratio h:w is in a range of approximately 0.32 and 0.7 as illustrated in FIG. 5 and the number of corrugated segments per inch as viewed in cross-section is in a range of approximately 8 and 24.

Furthermore, using those exemplary embodiments that direct the accumulated water towards the center of the housing reduces the likelihood of water accumulating on the outside edges of the fin and thereby reducing the likelihood that the flowing air will blow water droplets outside of the housing.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A high-frequency, low-amplitude corrugated fin for a heat exchanger coil assembly, comprising:

a plate member extending horizontally in a horizontal direction along an imaginary horizontal reference line and vertically in a vertical direction along an imaginary vertical reference line to define a reference plane as viewed in side elevation and at least one zone as viewed in front elevation, the plate member having an opposing pair of horizontally-extending side edges and an opposing pair of vertically-extending side edges with respective ones of the vertically-extending side edges and the horizontally-extending side edges joining one another to form a generally rectangularly-shaped plate member as viewed in front elevation, the plate member having a plurality of conduit portions and a first series of corrugated segments and a second series of corrugated segments formed into the plate member, each one of the first series of corrugated segments angling away from the imaginary horizontal reference line and each one of the second series of corrugated segments angling toward the imaginary horizontal reference line as viewed from one of the vertically-extending side edges towards a remaining one of the vertically-extending side edges, the first and second series of corrugated segments undulating generally equidistantly relative to and from the reference plane as viewed in cross-section, the at least one zone divided into a first sub-zone and a second sub-zone disposed horizontally juxtaposed to the first sub-zone, the plurality of conduit portions being inter-dispersed throughout the plate member among the first and second series of corrugated segments, each conduit portion having a flat piece and a collar, each flat piece being generally disposed in the reference plane and having a hole formed transversely therethrough, a respective collar connected to and projecting from a corresponding one of the flat pieces to define a transversely extending conduit in communication with the hole, wherein each one of the first series of corrugated segments extend at a first angle relative to the horizontal direction and each one of the second series of corrugated segments extend at a second angle relative to the horizontal direction such that individual adjacent ones of the first and second series of corrugated segments form a generally chevron-shaped configuration as viewed in front elevation, wherein the first sub-zone includes at least one vertically-extending column of first conduit portions and the second sub-zone includes at least one vertically-extending column of second conduit portions, wherein respective ones of the collars of the first conduit portions are disposed entirely within the first sub-zone as viewed in front elevation and respective ones of the collars of the second conduit portions are disposed entirely within the second sub-zone as viewed in front elevation and wherein at least a plurality of the first and second series of corrugated segments extend substantially entirely across the extent of said first and second sub-zones, respectively, such that all of the corrugated segments within the first sub-zone which cross the horizontal reference line or the vertical reference line extend substantially at the same first angle relative to the horizontal reference line or the vertical reference line, and all the corrugated segments within the second sub-zone which cross the horizontal reference line or the vertical reference line extend substantially at the same angle relative to the horizontal reference line or the vertical reference line, the first and second angles being substantially different, and a transition between the first series of corrugated segments extending at the first angle and the second series of corrugated segments extending at the second angle defines a boundary between the horizontally-juxtaposed first and second sub-zones.

* * * * *